United States Patent [19]

Mackey

[11] 4,125,968

[45] Nov. 21, 1978

[54] HIGH SPEED GRINDING TOOL

[75] Inventor: Richard C. Mackey, Painesville, Ohio

[73] Assignee: Air Tool Service Company, Willoughby, Ohio

[21] Appl. No.: 823,224

[22] Filed: Aug. 10, 1977

[51] Int. Cl.[2] ..... B24B 23/00

[52] U.S. Cl. ..... 51/170 R; 51/134.5 F

[58] Field of Search ..... 51/134.5 F, 170 R, 170 T, 51/170 PT, 266, 356

[56] References Cited

U.S. PATENT DOCUMENTS

| | | | |
|---|---|---|---|
| 831,272 | 9/1906 | Fletcher | 51/134.5 F |
| 1,990,036 | 2/1935 | Kratz et al. | 51/170 T |
| 3,251,086 | 5/1966 | Springer | 51/170 T |

FOREIGN PATENT DOCUMENTS

| | | | |
|---|---|---|---|
| 2,325,122 | 12/1973 | Fed. Rep. of Germany | 51/170 T |
| 1,110,553 | 10/1955 | France | 51/170 T |

*Primary Examiner*—Harold D. Whitehead
*Assistant Examiner*—Roscoe V. Parker, Jr.
*Attorney, Agent, or Firm*—Bosworth, Sessions & McCoy

[57] ABSTRACT

A portable lightweight angle grinder is disclosed having a motor housing with a handgrip and throttle lever, a rotary air motor driving a motor spindle, an elongated air-cooled tubular extension housing adjustably mounted on said motor housing, a work spindle near the end of said extension, toothed pulleys on the work spindle and the motor spindle, and an endless neoprene belt within said extension housing with teeth that mesh with the teeth of said pulleys. The unique toothed belt drive requires no lubrication, operates efficiently at speeds up to 25,000 revolutions per minute and at least twice that normally used in conventional angle grinders using gear drives, and can be maintained in service at a fraction of the cost of the prior devices.

4 Claims, 5 Drawing Figures

FIG. 2
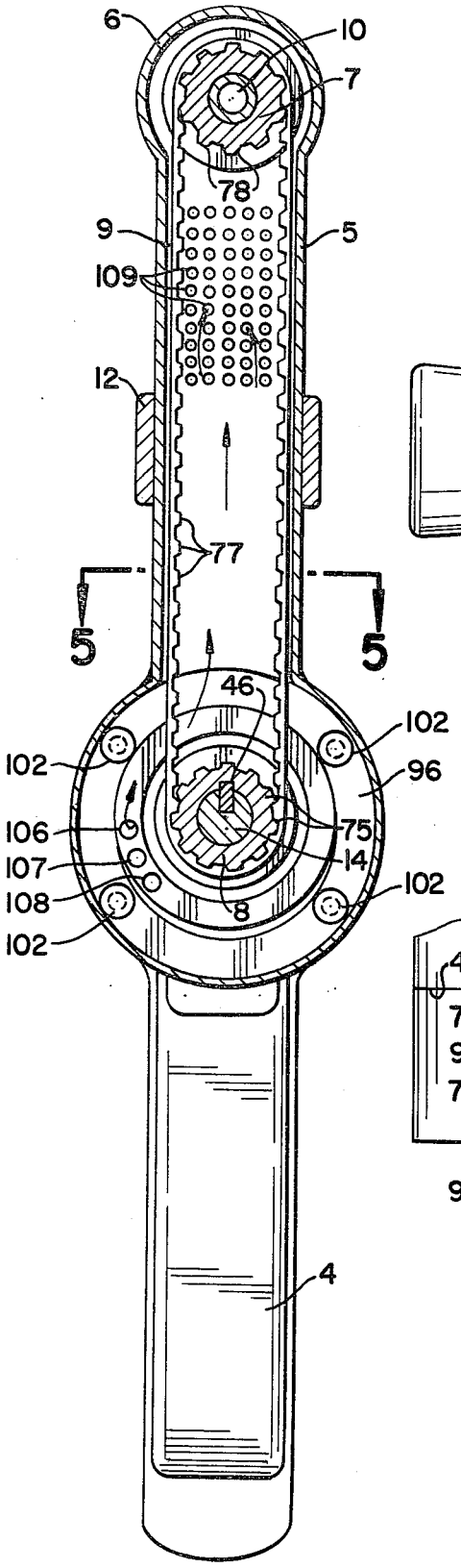
FIG. 3
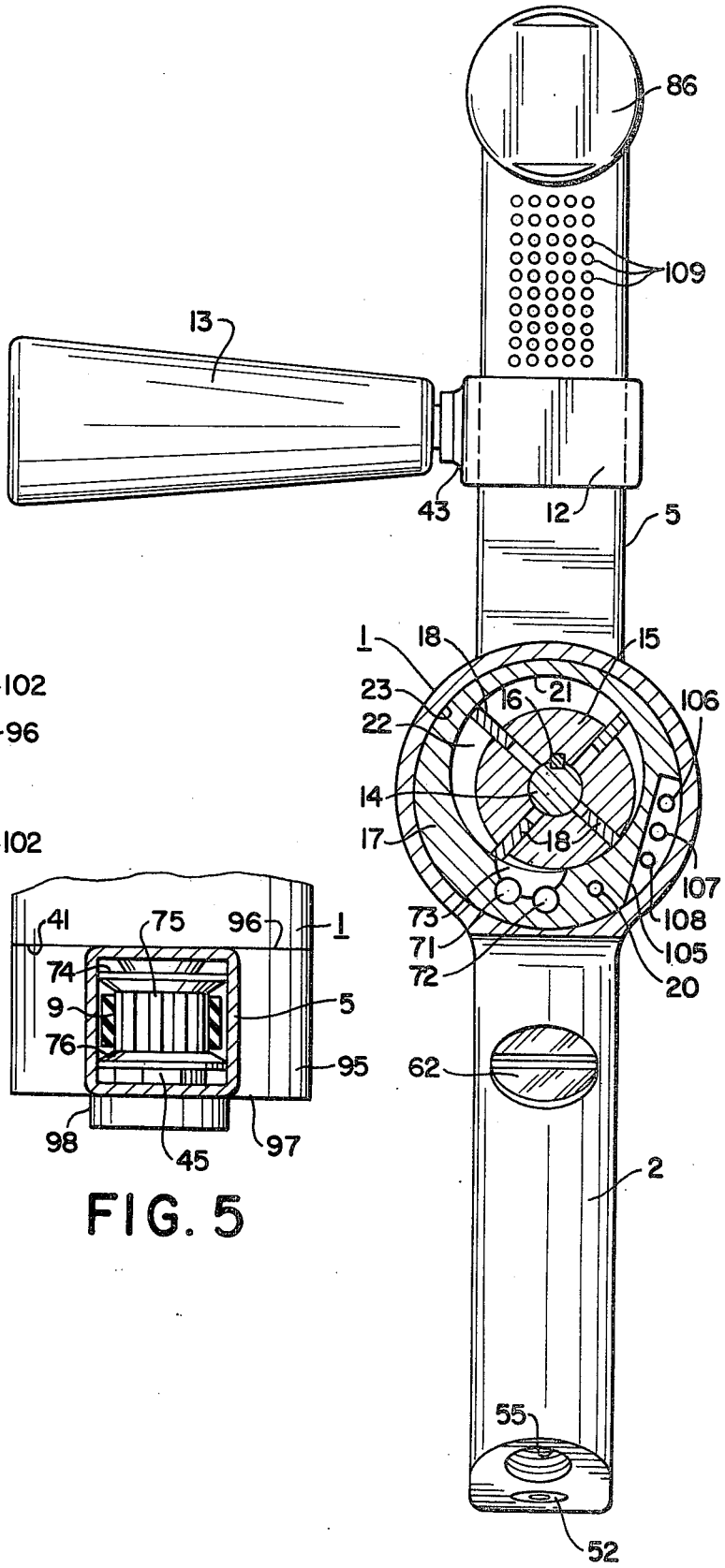
FIG. 5

HIGH SPEED GRINDING TOOL

The present invention relates to small portable air tools specially designed for grinding in corners and more particularly to portable angle grinders having a work spindle spaced at least several inches from the rotor shaft of the air motor.

BACKGROUND OF THE INVENTION

The more common portable air tools have the shaft of the air motor connected to the grinding or cutting tool directly so that the tool is coaxial with the shaft. In order to facilitate more difficult grinding operations, such as the grinding of corners, special air tools known as "angle grinders" are provided having work spindles spaced radially at least several inches from the motor spindle and having positive gear drive means between the motor spindle and the work spindle. These angle grinders have been used for many years.

Heretofore, the drive means for these angle grinders usually consisted of bevel gears which were relatively expensive and required lubrication to avoid excessive wear. A set of such gears could, for example, cost 30 to 40 dollars or more. Because the lubricant is thrown off by centrifugal force at speeds substantially in excess of 8000 revolutions per minute, the gears of these air tools cannot be lubricated properly and wear out rapidly if operated at higher speeds. These tools are inefficient and generally unsatisfactory when used with grinding wheels having an external diameter substantially less than 2 inches.

If, for example, a 1-inch diameter grinding wheel was desired for grinding small diameter fillers, the wheel speed should theoretically be more than 15,000 revolutions per minute for effective grinding, but a portable angle grinder of the type made prior to this invention could not be operated at such speeds without wearing out the gears. The lubricant would be thrown off as fast as it was applied. As a practical matter, the cost of replacing the bevel gears would be prohibitive at such speeds. Operation of the small diameter grinding tools on such angle grinders at lower speeds was not satisfactory because they do not remove metal effectively when operated in that manner.

This problem has existed for more than two decades, and no satisfactory solution was found prior to the present invention. Heretofore, it has been accepted that portable angle grinders should be operated at speeds well below 10,000 revolutions per minute to avoid excessive maintenance costs and should be used with grinding wheels having a diameter greater than 2 inches.

The present invention involves use of an unusual toothed belt drive. Heretofore conventional belt drives have sometimes been used in portable electric tools, such as belt sanders or the like, and they are suitable for use with electric motors because they slip to protect the motor from damage due to sudden stops. In recent years toothed belts have sometimes been used as timing belts for internal combustion engines, but their use for other purposes has been very limited.

SUMMARY OF THE INVENTION

The present invention provide an angle grinder which can be operated economically without lubrication at speeds of 15,000 to 25,000 revolutions per minute and solves the problems discussed above by providing a simple belt drive within a tubular housing extension of relatively small cross section, by eliminating the need for lubrication, by providing effective cooling of the tool, and by providing for ready placement of worn or damaged belts. The cost of the belts is a small fraction of the cost of the replacement gears used in the conventional angle grinders. The invention represents a major advance in the field of portable grinders because of the versatility of the air tool, its ability to operate effectively with grinding wheels and cutters of both small and medium diameter at speeds up to 25,000 revolutions per minute or greater, the very low maintenance cost, and the ease of inspecting and/or replacing worn or broken belts. The invention enables the operator to do a large volume of work with the angle grinder at minimum cost because the motor can be operated at the speed best suited for the particular size of grinding wheel. The high rotational speed of the tool also makes it suitable for use with rotary burrs and other small diameter cutters which could not be used on the angle grinders made prior to this invention.

The tool of this invention also provides an admirable solution to the noise problem by providing a housing for the belt drive which receives the motor exhaust and provides an excellent muffler.

In a preferred embodiment ofthe invention the angle grinder comprises a main motor housing with a lower handgrip portion having a throttle lever and a throttle valve, a rotary air motor with a spindle projecting from the motor housing, an auxiliary housing means including a small upper housing and a tubular muffler extension housing detachably connected to the front of the motor housing, a work spindle journaled for rotation in said upper housing and having a tool-receiving collet at the front end thereof, upper and lower pulleys mounted on said work spindle and said motor spindle, and a removable flexible endless belt mounted on the pulleys. The belt and the pulleys have intermeshing portions providing positive non-slip drive means, and each pulley preferably has a removable flange at one end to facilitate belt replacement. The extension housing is preferably connected to the main motor housing by circumferentially spaced screw means in such a manner that its position may be adjusted to increase or decrease the belt tension or to permit belt removal.

Objects of the invention are to provide a simple economical angle grinder which is reliable and convenient to operate and which can be operated without belt lubrication at high speeds in excess of 20,000 revolutions per minute and to provide an angle grinder which can be maintained in several at low cost when used with grinding tools or rotary burrs of small diameter. These and other objects, uses and advantages of the invention will become apparent to those skilled in the art from the drawings, description and claims hereof.

BRIEF DESCRIPTION OF THE DRAWINGS

In the drawings:

FIG. 2 is a transverse vertical sectional view taken on the line 2—2 of FIG. 1 and on the same scale;

FIG. 3 is a transverse sectional view taken substantially on the line 3—3 of FIG. 1;

FIG. 5 is a fragmentary horizontal sectional view taken on the line 5—5 of FIG. 2.

DESCRIPTION OF THE PREFERRED EMBODIMENTS

Figure 1:
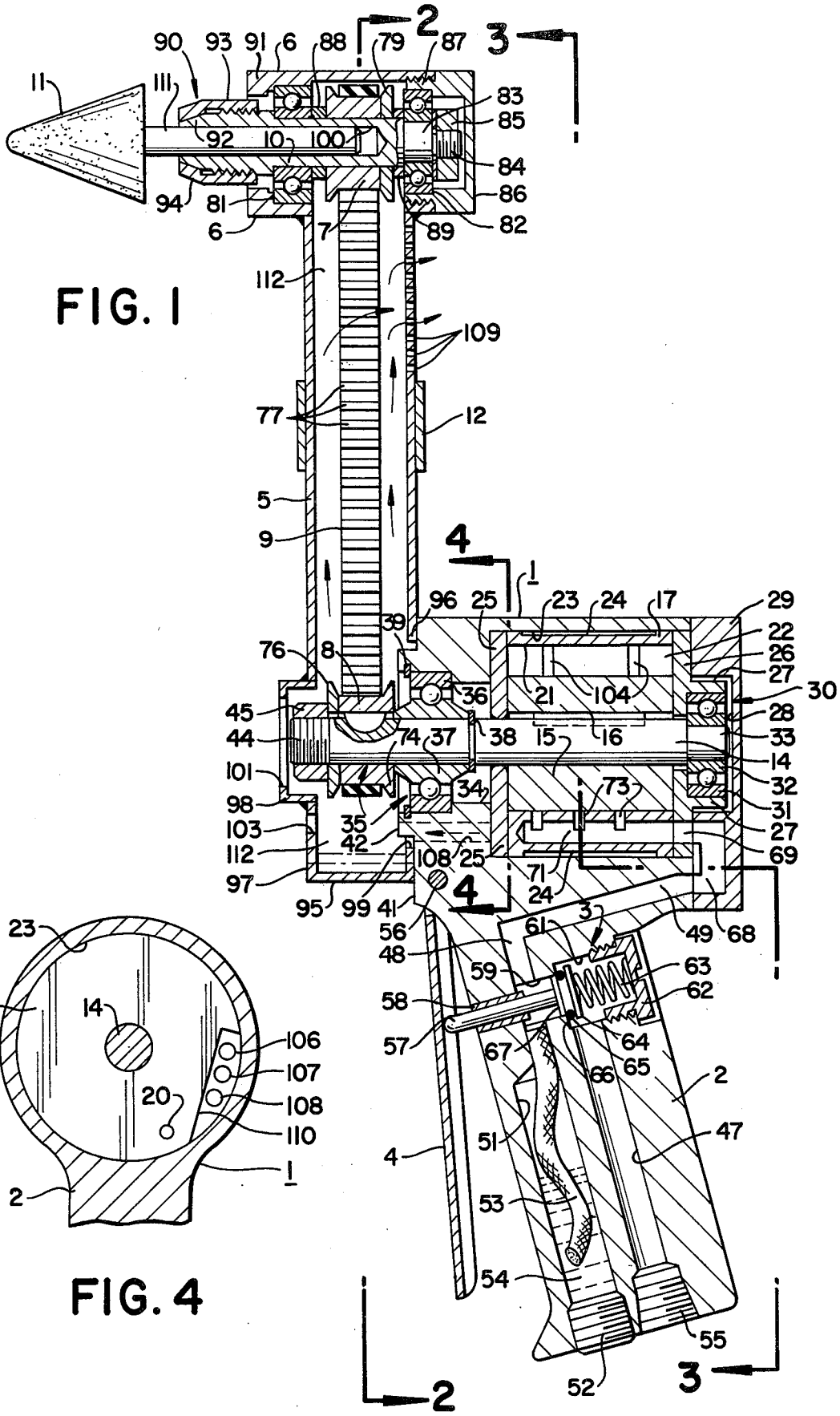
FIG. 1 is a vertical sectional view showing a portable angle grinder constructed according to the present invention.
Figure 4:
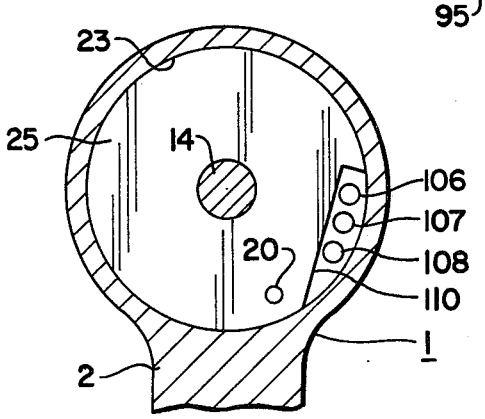
FIG. 4 is a fragmentary transverse vertical sectional view taken on the line 4—4 of FIG. 1.

Referring more particularly to the drawings, which are drawn substantially to scale and in which like parts are identified by the same numerals throughout the several views, FIGS. 1 to 5 illustrate one embodiment of a portable angle grinder A constructed according to the present invention and having a main motor housing 1 in the form of a light-weight metal casting shaped to receive a conventional air motor B and having a hand grip extension portion 2 which contains a conventional throttle valve 3 operated by a throttle lever 4. In accordance with the invention, there is provided a tubular muffler extension housing 5, a work-spindle housing 6 welded to the housing 5, and a pair of toothed pulleys or gears 7 and 8 within the housings for receiving a toothed drive belt 9, which drives the work spindle 10 and the cutting or grinding tool 11 carried thereby. An adjustable collar 12 is provided to support a handle 13. The collar has a cross section similar to that of the extension 5 to permit axial sliding thereon and has an internally threaded portion of the handle 13 which engages the extension 5 to lock the collar in fixed adjusted positions.

The lower pulley 8 is mounted on the motor spindle 14 for rotation in unison therewith and is driven by the air motor B, which may be of a conventional type. As herein shown the air motor is of the expansible-chamber sliding-vane type and comprises an externally cylindrical rotor 15 coaxial with the spindle and connected thereto by a rotor key 16, which fits in aligned slots of the spindle and the rotor (FIG. 3), and an externally cylindrical stator 17 which fits in the housing 1 (See FIG. 3) to define an eccentrically disposed expansible chamber 22. The stator is held in a fixed position in the housing 1 by a locator pin 20 (FIG. 3) which extends through the stator and the end plates 25 and 26 into the housing. The rotor has conventional radial slots that receive radially movable rotor vanes 18 which are thrown outwardly by centrifugal force against the eccentric internal surface 21 of the stator 17.

The internal surface 21 of the stator may be cylindrical for ease of manufacture. The external surface of the stator is preferably cylindrical and of the same diameter as the internal cylindrical surface 23 of the housing 1. The stator is provided with suitable exhaust ports or the like and may, for example, have a series of axially spaced circumferential exhaust openings or slots 104 in communication with the chamber 22 and an external annular peripheral groove 24 to carry away the air exhausted from chamber 22.

Conventional front and rear circular end plates 25 and 26 are provided at opposite ends of the air motor with flat faces perpendicular to the motor spindle 14 and slidably engaging the flat end faces of the rotor 15 and the vanes 18. The plate 26 has a cylindrical flanged portion 27, coaxial with the spindle 14 and the housing surface 23, which receives a ball bearing 30 and projects into a circular recess 28 of a removable motor housing cap 29. The outer race 31 of the bearing fits the inner cylindrical surface of flange 27, and the inner race 32 fits the reduced cylindrical outer end portion 33 of the spindle.

At the opposite end of the air motor, the housing 1 is provided with a bore 34 extending outwardly from the end plate 25 to a ball bearing 35, which has an outer race 36 mounted in a counterbore of the housing coaxial with the spindle and an inner race 37 mounted on the spindle against the pulley 8 and held against axial movement by a conventional snap ring 38 located in a peripheral groove of the spindle. The outer race 36 is held against axial movement by an internal snap ring 39 located in an internal peripheral groove of the housing.

As shown, the cast metal housing 1 has a flat vertical face 41 of generally circular perimeter perpendicular to the motor spindle 14 and a short integral cylindrical projection 42 coaxial with the spindle. The end portion 44 of the spindle extends outwardly beyond the projection 42 and is externally threaded outwardly of the pulley 8 to receive a spindle nut 45. The spindle is slotted inwardly of the nut to receive a semi-circular or moon-shaped key 46 which fits in an axial slot of the pulley 8 (FIG. 2).

The handle-grip portion 2 of the housing 1 may be provided with any suitable throttle valve for controlling air flow to the air motor B. For example, the throttle valve may be similar to that shown in U.S. Pat. No. 3,753,469 (H. C. Tuttle). The valve may also be operated by a trigger such as illustrated in U.S. Pat. No. 2,337,897 or U.S. Pat. No. 2,947,283.

As herein shown, the handle portion 2 has a longitudinal air inlet passage 47, a short longitudinal air supply passage 48, a transverse air supply passage 49 extending outwardly from passage 48, and a longitudinal bore 51 of larger diameter extending downwardly from the passage 48 to provide a lubricant reservoir. An externally threaded plug 52 is screwed into the internally threaded end of the bore 51 after it has been filled with the oil 54. A conventional oiler felt 53 may be mounted in the bottom portion of the passage 48 as shown in FIG. 1 to permit slot movement of lubricant during operation of the air motor.

The housing 1 may be connected by a conventional flexible air hose (not shown) to a source of air under pressure. As shown, the air inlet passage 47 has a conventional internally threaded end portion 55 for receiving the external threaded connector of a standard air supply hose. The flow of compressed air may be controlled by movement of a throttle lever or trigger 4 which is mounted to swing on a pivot pin 56.

The lever 4 engages the cylindrical valve stem 57 of the throttle valve 3 which slides axially in an elongated cylindrical bushing 58. A bore 59 and a counterbore 61 are provided coaxial with the valve stem 57 to permit axial movement of the valve in a direction perpendicular to the passage 47. An externally threaded cup-shaped valve plug 62 is screwed into the internally threaded end of the counterbore 61 and receives a helical valve spring 63 which is compressed between the plug and the flat circular head 64 of the valve. A rubber O-ring 65 is mounted in a groove of the valve 3 between the head 64 and the cylindrical guide portion 67 at the end of the stem 57 and is normally held by the spring against the valve seat or shoulder 66 at the end of the counterbore 61. The guide portion 67 fits the bore 59 and slides axially to permit opening and closing of the valve by movement of the throttle lever.

when the valve 3 is opened by depressing lever 4, the compressed air from the passage 47 enters passage 48 and passes through the supply passage 49, the air passage 68 of the end plate 26 to the inlet passage 71 and 72 of the stator 17. A series of inlet slots 73 are located at one side of the stator to provide communication between the latter passages and the chamber 22 of the air motor, and a plurality of exhaust port, such as the slots 104, are located at or near the opposite side of the stator, whereby the compressed air effects driving the motor B, the motor spindle 14 and the lower pulley 8.

The work spindle 10 is positively driven by a unique driving means comprising toothed pulleys 7 and 8 and a toothed drive belt 9 of a type sometimes used in timing belts for small internal combustion engines. As shown the pulley 8 comprises an integral tapered flange portion 74 in engagement with the inner bearing race 37, a main central gear portion with integral teeth 75 which mesh with the integral teeth 77 of the flexible rubber belt 9, and a separate removable tapered outer flange 76 in engagement with the nut 45.

The upper pulley 7 may be the same as the pulley 8 and is keyed to or otherwise connected to the work spindle 10 to drive the same. Thus the pulley 7 may have an integral flange the same size as flange 74, a central portion with teeth 78 that mesh with the teeth 77 of the belt, and a removable flange 79 similar to flange 76. When the pulley 7 has the same diameter as the pulley 8, the work spindle 10 will rotate at the same speed as the motor spindle 14. If desired, the pulleys may be of different diameters. The pulley 8 can be replaced with a larger pulley if it is desired to increase the speed of rotation of the grinding tool 11, for example when the tool has a diameter less than that normally employed.

The extension housing 5 is adjustable and can be clamped in a position to provide any desired tension in the belt 9. When in an extended position as shown in FIGS. 1 and 2, it supports the housing 6 and the work spindle 10 with their axis parallel to the axis of the motor spindle 14. the work spindle is journaled for rotation in the housing 6 by ball bearings 81 and 82 or other suitable antifriction bearings. At the rear end of the spindle the inner race of the bearing 82 is mounted on the reduced cylindrical bearing portion 83 of the spindle and held in position by a spindle nut 85 screwed onto the threaded outer shaft portion 84. The spindle nut 85 is located within a cup-suaped removable bearing cap 86 having an externally threaded end portion 87 which is screwed into the internally threaded rear end portion of the cylindrical housing 6 and which fits the outer race of the rear bearing 82. The front end portion 91 of the housing 6 fits the outer race of the front bearing 81.

Annular spacers 88 and 89 are located on the spindle in engagement with the flanges of the upper pulley 7 and are of a size such that the pulleys 7 and 8 are in vertical alignment and the bearings 81 and 82 are held against axial movement after the spindle nut 85 has been tightened.

A collet 90 is provided for receiving the shaft 111 of the cutting or grinding tool 11, which may be a small cone-shaped grinding wheel, a hard metal burr or other common cutting tool. As shown, the collet includes the bore 100 and the split front portion 92 of the spindle 10 which is externally threaded rear end portion of a collet nut 93. The front portion 94 of the collet nut is tapered and fits the tapered end of the spindle 10 so a to force it radially inwardly into gripping engagement with the tool shaft 111 when the nut is tightened. The rear portion of the collet nut is externally cylindrical and of less diameter than the internal surface of the surrounding housing portion 91.

The extension housing 5 is shaped to enclose the belt 9 and to fit the main housing 1. It is preferably of rectangular cross section as shown in FIG. 5 but may have other shapes. As shown, the extension 5 has a generally cylindrical lower wall portion 95 integral with flat parallel lower wall portions 96 and 97 of the same radium. The wall portion 96 has a circular opening 99 concentric to the peripheral wall portion 42 of the main motor housing. The wall portion 97 has a smaller circular opening and a short integral cylindrical flange 98 welded to the wall portion 97 concentric to the peripheral wall portion 95. The flange has a circular tool-receiving opening 101 with a diameter greater than that of the spindle nut 45 to facilitate removal and replacement of the nut.

The wall portion 96 fits against the flat face 41 of the motor housing and has a series of regularly circumferentially spaced holes or slots for receiving a series of mounting screws 102 (FIG. 2) near the outer periphery which screw into the motor housing 1 outwardly of the annular projection 42. The wall portion 97 has a series of circular tool-receiving holes 103 (FIG. 1) in axial alignment with the screws 102 to provide access for tightening and loosening of the screws by a socket wrench or other tool inserted axially through the hole.

The air motor B creates substantial noise if the air is exhausted directly from the motor housing 1, and it is desirable to divert part or all of the exhaust air through a muffler. In the tool of the present invention the extension housing 5 serves as a muffler for recieving the exhaust air. As shown the stator 17 is cut away to provide a wide shallow recess 105 in communication with the exhaust groove 24, and the slots 104 and extending axially to the end plate 25 for receiving the exhaust air. The end plate 25 is also cut away to provide similar recess 110 in alignment with the recess 105 and in alignment with three exhaust passages 106, 107 and 108 which extend between the plate 25 and the interior of the housing extension 5. The exhaust air passes from the motor B through these three passages to the extension 5, then upwardly toward the upper pulley 7, and then outwardly through a multiplicity of small diameter exhaust openings 109 as indicated by the arrows in FIG. 1. This arrangement muffles the sound, reduces the speed of the exhaust gas to a more tolerable level, ventilates the extension 5 to cool the belt 9, and prevents heat buildup due to the frictional heat from tool 11.

The tool shown herein is constructed to facilitate removal and inspection of the belt 9 and replacement when it is worn or broken. This may be done without removing the muffler extension housing 5 by removing the spindle nut 45 and the adjacent pulley flange 76, by removing the cap 86 and the spindle nut 85, and by sliding the bearing 82, the spacer 89 and the pulley flange 79 off of the work spindle 10. A new belt may be inserted through the open rear end portion of the housing 6, pulled down through extension 5, placed around the lower pulley 8, and finally placed around the upper pulley 7.

This is facilitated by loosening the screws 102 by a tool inserted through holes 103 and lowering the housing 6 a fraction of an inch toward the housing 1. The opening 99 of the extension housing is large enough to permit a substantial adjustment such as ¼ to ½ inch or so. After the belt 9 is positioned on the pulley flanges and other parts are replaced and the screws 102 are tightened after the extension 5 is adjusted to the desired position to provide the proper tension in the belt.

The belt 9 may be of various conventional abrasion-resistant rubber compositions. It is preferably inforced with tire cord fabric or the like. Excellent results are obtained, for example, where the belt is formed from an oil-resistant elastic rubber, such as neoprene or chloroprene. The rubber is preferably of a type suitable for or commonly used in drive belts or the like and preferably has a tensile strength of 2000 to 4000 pounds per square inch or higher after being compounded with conventional compounding ingredients, such as curing agents, stearic acid, magnesium oxide, zinc oxide, antioxidants, reinforcing fillers, carbon black, or the like.

Excellent results can be obtained with various neoprene rubbers or polymers of chloroprene. For example, a general purpose Neoprene type GN type rubber or Neoprene type W rubber may be used with the usual compounding ingredients and curing agents. The neoprene rubber and fabric reinforcement used in the belt 9 may, for example, be the same as is used in automobile timing belts.

It will be apparent that the main motor housing 1, the hand-grip extension portion 2, the throttle valve 3 and associated parts may be of various constructions and may be generally similar to conventional portable rotary air tools as disclosed, for example in U.S. Pat. No. 1,940,024; 2,337,897; 2,830,560 and 2,947,283. It will be apparent that conventional mufflers may be employed in place of the muffling means illustrated herein.

The tubular muffler extension 5 functions effectively to minimize noise from the motor exhaust. The exhaust air from the air motor B passes rapidly through exhaust slots 104, the peripheral exhaust groove 24, the exhaust recess 105, exhaust passages 106, 107 and 108, and the exhaust recess 110 to the interior chamber 112 of the extension housing 5 and then moves slowly through the housing from the motor spindle 14 to the small exhaust openings 109.

The neoprene belt 9 is not damaged by the oil in the exhaust air and does not require lubrication. It has a long useful lift even when operated at very high speeds such as 15,000 to 20,000 revolutions per minute or higher. The cost of belt replacement is a small fraction of the cost of replacing gears in the conventional angle grinders heretofore used.

In order to function in the desired manner and to obtain the desired service life, it is important to eliminate slippage and to provide toothed belts. Conventional belts are not satisfactory and are subject to rapid wear at high speeds. The toothed belts provide a positive drive which sometimes results in rapid deceleration or stopping of the motor B. This would damage an electric motor, and it is essential to employ an air motor which is not damaged by rapid stops.

The positive drive enables the grinding or cutting tool 11 to remove material rapidly and effectively even when the tool has a small diameter, such as 1 inch or less.

The portable lightweight angle grinder A shown herein is of a general purpose type designed for use with cutting tools or grinders having an external diameter from 1 inch to 6 inches, and can be operated at high speeds from 15,000 to 25,000 revolutions per minute. It will be apparent that the size of the grinder can vary substantially. The particular grinder illustrated employs a 1-horsepower air motor B and can have a weight from 2.5 to 3 pounds. This type of grinder usually employs pulleys 7 and 8 having an external diameter of 0.6 inch to 1.5 inches and having their axes spaced apart 5 to 10 inches, and the housing extension 5 usually has a length of 6 to 10 inches or so. With grinders of this size, the handle grip portion 2 and handle 13 provide a convenient and reliable means for supporting the tool during use.

Because the angle grinder of this invention employing a toothed belt drive can be operated at least twice as fast as conventional angle grinders with a gear drive, grinding, deburring or finishing operations can be carried out more rapidly and more efficiently, and cutting or grinding tools of small diameter can be used effectively at high speeds in excess of 20,000 revolutions per minute which heretofore were not considered feasible. The grinder of this invention makes it possible to use burrs and grinding wheels with very small diameters, from ½ inch to 1 inch, for example, and to operate at speeds in excess of 25,000 revolutions per minute when using the small tools. The versability and low maintenance costs associated with the angle grinder of this invention are so remarkable that it may render the conventional grinders obsolete.

It will be understood that, in accordance with the patent laws, variations and modifications of the specific devices shown herein may be made without departing from the spirit of the invention.

Having described my invention, I claim:

1. In a portable lightweight angle grinder comprising a motor housing, a motor spindle journaled for rotation in said housing, a rotary air motor in said housing having a fixed stator and a rotor within the stator and mounted on said spindle, said air motor having air inlet and exhaust openings and means for supplying compressed air to the inlet openings, manually operated valve means for controlling the flow of air to the air motor, and outer housing spaced from and carried by said motor housing, a work spindle journaled for rotation in said outer housing, means at the end of the work spindle for detachably mounting the shaft of a cutting or grinding tool, and drive means operably connecting said motor spindle to said work spindle to drive the same, the improvement wherein said drive means comprises a pair of wheels of small diameter and a flexible endless band mounted on the wheels to effect rotation of the work spindle at a speed in excess of 20,000 revolutions per minute, said wheels comprise replaceable upper and lower pulleys with external teeth regularly spaced around the periphery, said band comprises a molded belt of elastomeric material having teeth which mesh with the teeth of said pulleys, an axially elongated tubular extension is provided between said motor housing and said outer housing to support said outer housing, adjustable means are provided for mounting said tubular extension whereby the distance between the motor spindle and the work spindle can be changed to adjust the tension in the belt, said tubular extension is rigidly connected to said outer housing and has a lower end detachably mounted on one end of said motor housing, and screw means for holding said extension in adjusted positions on said motor housing, said tubular extension comprising a muffler housing enclosing said belt and the lower pulley and having a multiplicity of small exhaust openings, said air motor having exhaust passages discharging air to the interior of said muffler housing.

2. A portable air tool according to claim 1 wherein said tubular extension has a uniform cross section, said exhaust openings are closely spaced along the length of said extension, and a collar is adjustably mounted on said tubular extension to slide to adjusted positions along the length thereof, all of the exhaust gases from said air motor being discharged to said extension, whereby the rate of air flow can be varied by adjustment of the position of said collar.

3. A portable air tool according to claim 1 wherein said motor housing has an outwardly projecting handgrip portion containing a throttle valve for controlling flow of air to the air motor and wherein a collar is adjustably mounted on said tubular extension to slide to adjusted positions along the length thereof, and a handle is carried by said collar, said handle extending in a direction transverse to the direction of said handgrip portion.

4. A portable air tool according to claim 1 wherein said wheels comprise pulleys with a diameter not in excess of 1 inch, said motor spindle and said work spindle have parallel axes spaced apart from about 4 to about 8 inches, and said air tool has a total weight not in excess of 3 pounds.

* * * * *